US010596684B2

(12) United States Patent
Merrick et al.

(10) Patent No.: US 10,596,684 B2
(45) Date of Patent: Mar. 24, 2020

(54) EXPANDABLE TORQUE TOOL

(71) Applicant: ToolTech, LLC, Phoenix, AZ (US)

(72) Inventors: Jake Merrick, Hinton, OK (US); Lucas Taylor, Philadelphia, PA (US)

(73) Assignee: ToolTech, LLC, Phoenix, AZ (US)

( * ) Notice: Subject to any disclaimer, the term of this patent is extended or adjusted under 35 U.S.C. 154(b) by 466 days.

(21) Appl. No.: 15/442,852

(22) Filed: Feb. 27, 2017

(65) Prior Publication Data

US 2017/0291285 A1 Oct. 12, 2017

Related U.S. Application Data

(60) Provisional application No. 62/321,464, filed on Apr. 12, 2016.

(51) Int. Cl.

| | |
|---|---|
| ***B25B 13/18*** | (2006.01) |
| ***B25B 13/06*** | (2006.01) |
| ***B25B 13/44*** | (2006.01) |
| ***B25B 15/00*** | (2006.01) |

(52) U.S. Cl.

CPC ..... *B25B 13/06* (2013.01); *B25B 13/44* (2013.01); *B25B 15/008* (2013.01)

(58) Field of Classification Search

None

See application file for complete search history.

(56) References Cited

U.S. PATENT DOCUMENTS

| | | | | |
|---|---|---|---|---|
| 4,842,288 | A * | 6/1989 | Ando | B23B 31/123 279/60 |
| 8,955,414 | B2 | 2/2015 | Merrick | |
| 8,997,608 | B2 | 4/2015 | Merrick | |
| 9,132,531 | B2 | 9/2015 | Merrick | |
| 9,138,873 | B2 | 9/2015 | Merrick | |
| 9,278,434 | B2 | 3/2016 | Merrick | |
| 2003/0010160 | A1* | 1/2003 | Dugan | B25B 13/5083 81/446 |
| 2014/0224084 | A1 | 8/2014 | Merrick | |

(Continued)

FOREIGN PATENT DOCUMENTS

| | | | |
|---|---|---|---|
| WO | 2014127223 | A1 | 8/2014 |
| WO | 2014127228 | A1 | 8/2014 |

(Continued)

*Primary Examiner* — Brian D Keller

(74) *Attorney, Agent, or Firm* — Bracewell LLP; James E. Bradley

(57) ABSTRACT

A tool has a body with an axially extending cavity containing partly cylindrical receptacles. Each receptacle has an opening facing inward toward the axis. A partly cylindrical cam portion of a jaw fits within each of the receptacles. Each jaw has a workpiece engaging portion protruding from the body. Each of the cam portions has a pair of flat flanks that protrude inward from the opening of one of the receptacles. The flat flanks intersect each other at an inner corner. Each flank abuts one of the flanks of another of the cam members. Each of the engaging portions has an outer surface configured to engage a hole within the workpiece. An increment of rotation of the body relative to the jaws causes the inner corners of the flanks to move outward from the axis and the outer surfaces of the engaging portions to move from a contracted position to an expanded position.

21 Claims, 8 Drawing Sheets

(56) References Cited

U.S. PATENT DOCUMENTS

| | | | |
|---|---|---|---|
| 2015/0231773 | A1 | 8/2015 | Merrick |
| 2015/0343613 | A1 | 12/2015 | Merrick |
| 2015/0343615 | A1 | 12/2015 | Merrick |
| 2015/0343624 | A1 | 12/2015 | Merrick |

FOREIGN PATENT DOCUMENTS

| | | | |
|---|---|---|---|
| WO | 2014127233 | A1 | 8/2014 |
| WO | 2014127237 | A1 | 8/2014 |
| WO | 2014127239 | A1 | 8/2014 |

* cited by examiner

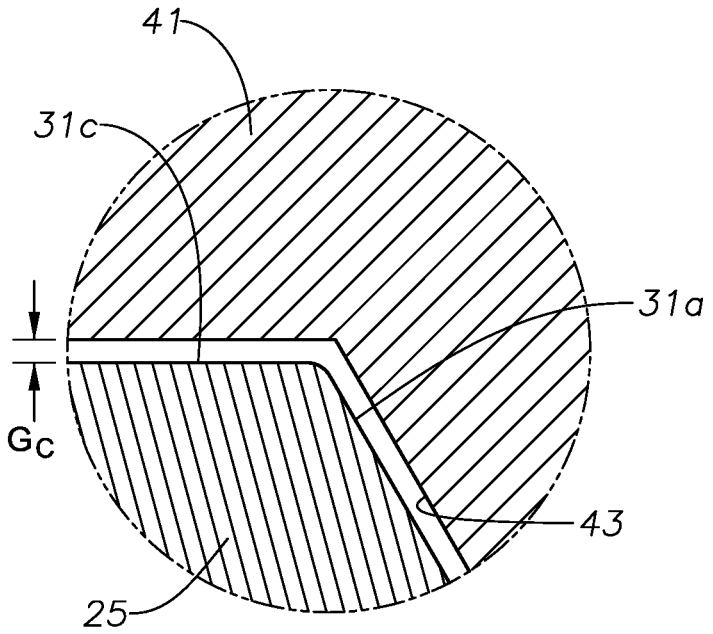
FIG. 8
FIG. 9
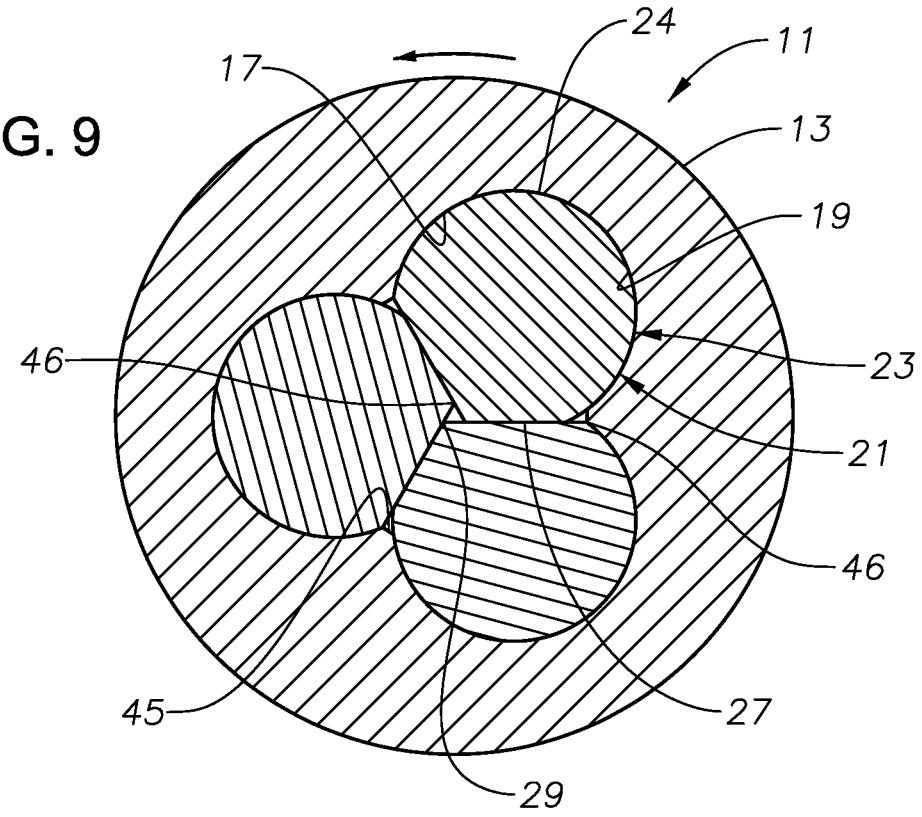

EXPANDABLE TORQUE TOOL

CROSS REFERENCE TO RELATED APPLICATION

This application claims priority to provisional application Ser. No. 62/321,464, filed Apr. 12, 2016.

FIELD OF THE DISCLOSURE

This disclosure relates in general to tools for applying torque to threaded fasteners and in particular to a tool that expands within a socket or hole in a workpiece to transfer torque.

BACKGROUND

Many fasteners are threaded into threaded holes. A variety of heads or ends are employed to be engaged by a tool and rotated to fasten or loosen. Some heads have cavities with flat drive flanks, such as Allen keys. The drive flanks may have a hexagonal configuration, in which case the tool has mating drive flanks. The tool may be simply an L-shaped rod with a hexagonal exterior. If due to rust or other conditions, the fastener is stuck, often the flanks of the tool will slip on the drive flats, failing to break the fastener loose.

Regardless of the type of fastener, a worker may have to resort to removing a stuck fastener in a "Dutchman fashion" by drilling a hole in the fastener. He would insert a Dutchman tool into the hole to grip the fastener and allow rotation in reverse. The Dutchman tool may be a tap with reverse threads, or the Dutchman tool may have jaws that expand in response to rotation of a cam member.

SUMMARY

An apparatus for engaging and rotating a workpiece has a body having a longitudinal axis and an axially extending cavity. The cavity has a plurality of partly cylindrical receptacles, each of the receptacles having an opening facing inward toward the axis. A jaw having a cam portion fits within each of the receptacles. Each of the jaws has a workpiece engaging portion protruding from the body. Each of the cam portions has a partly cylindrical outer surface that is received within one of the receptacles. Each of the cam portions has a pair of flat flanks that protrude inward from the opening of one of the receptacles. The flat flanks intersect each other at an inner corner. Each of the flanks of each of the cam members abuts one of the flanks of another of the cam members. Each of the engaging portions has an outer surface configured to engage part of a hole within the workpiece. An increment of rotation of the body relative to the jaws causes the inner corners of the flanks to move outward from the axis and the outer surfaces of the engaging portions to move from a contracted position to an expanded position.

In the embodiments shown, the partly cylindrical portion of each of the receptacles from one edge of the opening to another edge of the opening extends greater than 180 degrees. A corner ridge in the cavity divides each edge of each of the receptacles from adjacent ones of the receptacles. Each of the corner ridges is parallel with and located closer to the axis that a centerline of each of the receptacles.

In the embodiments shown, there are three of the receptacles. Each of the cam portions has an outer corner dividing one edge of the partly cylindrical outer surface from one of the flat flanks. While in the contracted position, each of the corner ridges is radially aligned with one of the outer corners. While in the expanded position, each of the corner ridges is radially misaligned with one of the outer corners.

In the embodiments shown, the flanks of each of the cam portions extend axially through and to a tip of each of the engaging portions. Each of the engaging portions may comprise a single integral piece with one of the cam portions.

In one embodiment, the outer surfaces of the engaging members define a polygonal configuration. More specifically, the outer surface of each of the engaging members has a center drive flat and a lateral drive flat on opposite edges of the center drive flat. The center drive flat has a width twice that of each of the lateral drive flats. The center and lateral drive flats of each of the engaging members are configured such that while in the expanded position one of the lateral drive flats will be in abutment with a flat drive surface in the hole of the work piece to impart torque and the other of the lateral drive flats will be spaced by a gap from another of the flat drives surfaces in the hole of the work piece.

In another embodiment, the outer surface of each of the engaging portions is a curved surface. Teeth are located on the outer surface for gripping the hole in the workpiece while in the expanded position. More specifically, the outer curved surface has a first portion and a second portion. The first portion comprises a smooth cylindrical surface having a radius emanating from the inner corner. The second portion comprises a plurality of teeth located along a curved surface having a different radius than the radius of the first portion for gripping the hole in the workpiece while in the expanded position.

The first portion may be configured to be concentric with part of the hole in the workpiece and the second portion may be configured to be misaligned with part of the hole in the workpiece while the jaws are in the contracted position. The second portion may be configured to be concentric with part of the hole in the workpiece, and the first portion may be configured to be misaligned with part of the hole in the workpiece while the jaws are in the expanded position.

BRIEF DESCRIPTION OF THE DRAWINGS

FIG. 8 is an enlarged sectional view of the portion encircled in FIG. 7.

FIG. 9 is a sectional view similar to FIG. 6, but showing the jaws expanded.

Figure 3:
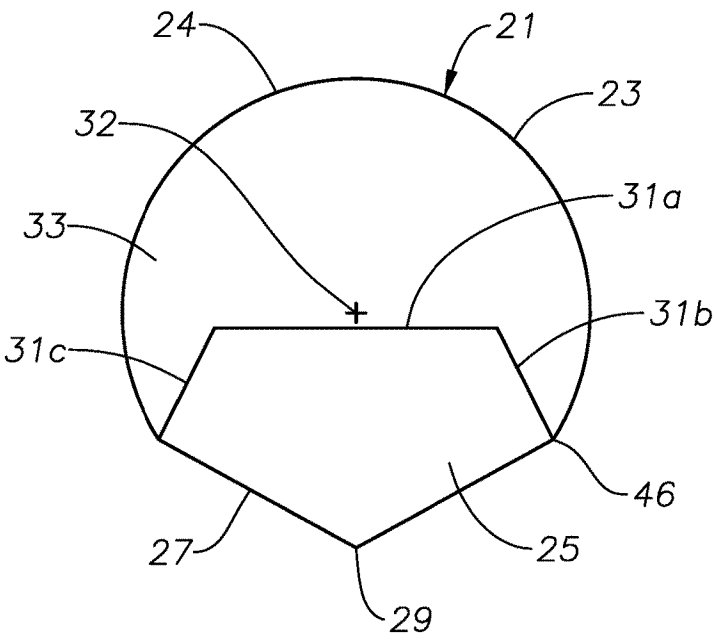
FIG. 3 is a top view of one of the jaws of the tool of FIG. 1.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
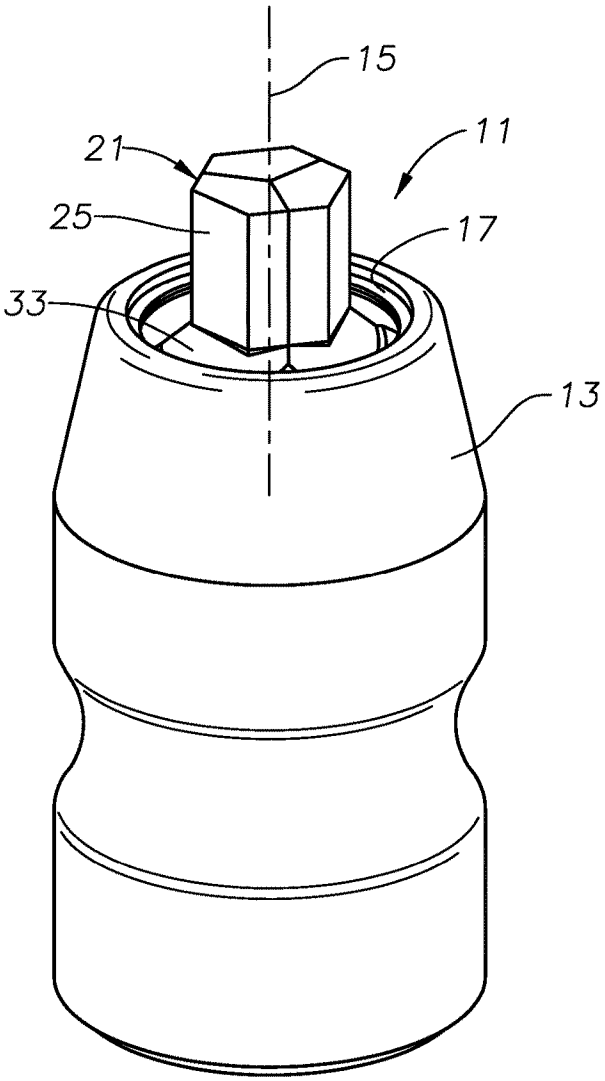
FIG. 1 is a perspective view of an expandable tool in accordance with this disclosure.
Figure 2:
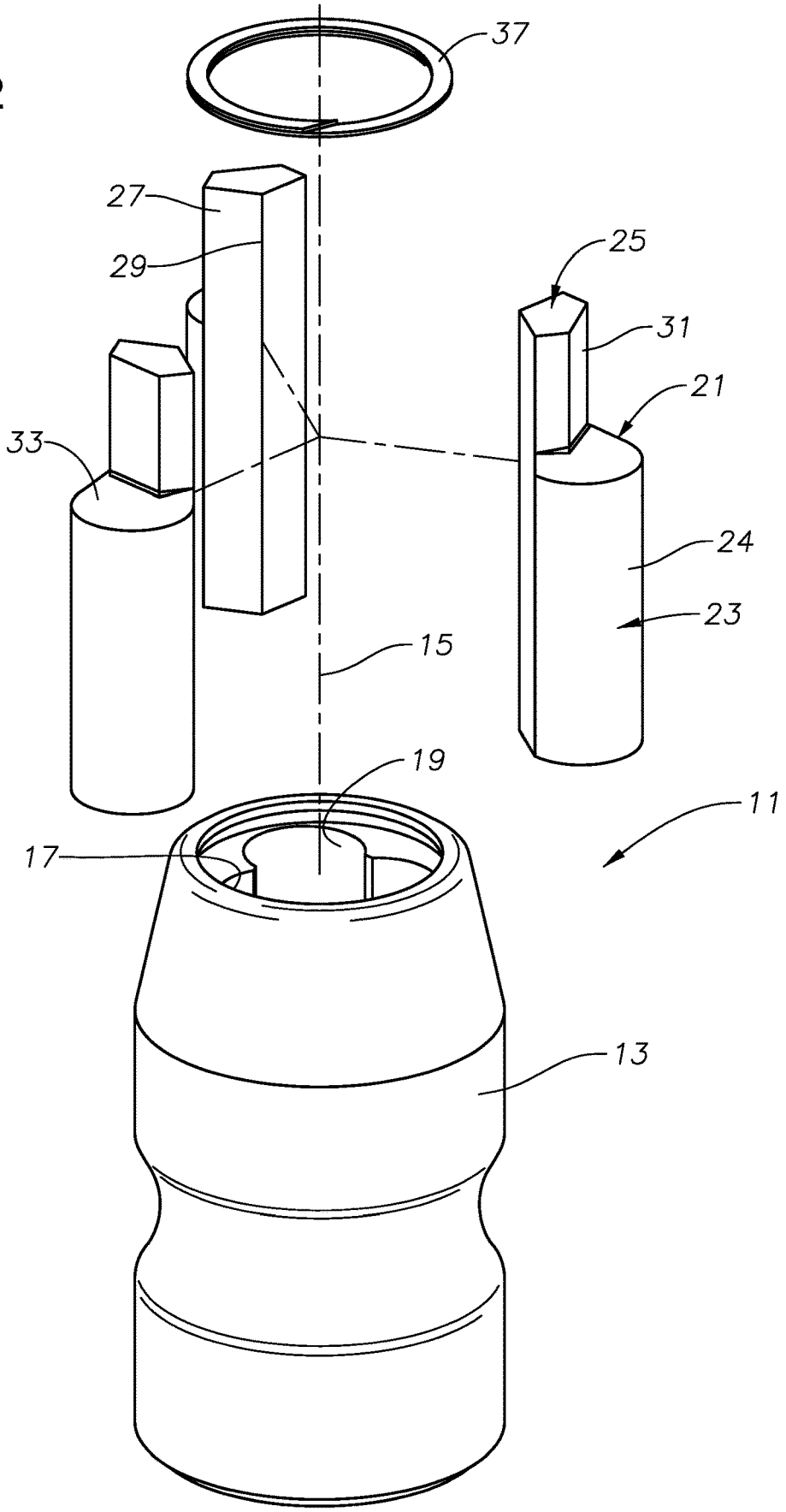
FIG. 2 is an exploded perspective view of the tool of FIG. 1.

Referring to FIGS. 1 and 2, a torque tool 11 has a metal body 13 with a longitudinal axis 15. Body 13 has a cavity 17 extending along axis 15. Cavity 17 has plurality of receptacles 19 formed therein. In this example, there are three receptacles 19 with centerlines located 120 degrees from each other, each outward from axis 15. Each receptacle 19 comprises a partly cylindrical recess with its centerline parallel with axis 15 and a central opening facing axis 15. In this embodiment, each receptacle 19 extends circumferentially greater than 180 degrees and less than 360 degrees, and is shown to extend about 240 degrees.

A jaw 21 having a cam portion 23 fits within each receptacle 19. Each cam portion 23 has an outer surface 24 that is also partly cylindrical, extending about the same circumferential amount as each receptacle 19. The radius of each jaw cam portion outer surface 24 is slightly smaller than the radius of each receptacle 19, enabling a small amount of relative rotation of body 13 relative to jaws 21.

Each jaw 21 has an engaging portion 25 protruding from body 13. Two flat inner flanks 27 extend continuously the length of each jaw 21 on the inner surfaces of cam portion 23 and engaging portion 25. Inner flanks 27 of each jaw 21 intersect each other at an inner corner 29. The angle of intersection of inner corner 29 may vary and is illustrated to be an obtuse angle of about 120 degrees. Inner flanks 27 are identical in width, which positions inner corner 29 of each jaw 21 substantially at axis 15 while jaws 21 are in a contracted position.

Each engaging portion 25 of jaw 21 has at least one drive flank or flat 31 on its outer side, relative to axis 15. In this embodiment, referring to FIG. 3, each engaging portion 25 has three drive flats 31, including a larger width central drive flat 31*a* bordered on each side by lateral drive flats 31*b*, 31*c*. Drive flats 31*a*, 31*b* and 31*c* intersect each other at 120 degree angles in this example to define a hexagonal configuration for the assembled engaging portions 25. Central drive flat 31*a* has twice the width of each of the lateral drive flats 31*b*, 31*c*.

Referring still to FIG. 3, each jaw 21 has a centerline 32; the radius of each cam portion outer surface 24 extends from centerline 32. The distance from inner corner 29 to centerline 32 may be about the same as the radius of cam portion outer surface 24. In this embodiment, the transverse dimension of engaging portion 25 from inner corner 29 to the midpoint of middle drive flat 31*a* is less than the distance from inner corner 29 to the midpoint of cam portion outer surface 24. In the example shown, the distance from inner corner 29 to the midpoint of middle drive flat 31*a* is slightly less than the radius of cam portion outer surface 24.

Referring also to FIG. 2, an outward biased retainer ring 37 or some other device retains jaws 21 within body 13. Each jaw 21 has a shelf 33 at the junction of engaging portion 25 with cam portion 23. Shelf 33 is generally flat, but slightly rounded for reducing stress, and faces in an axial direction away from cavity 17. Retainer ring 37 engages shelf 33 when jaws 21 are installed.

Figure 4:
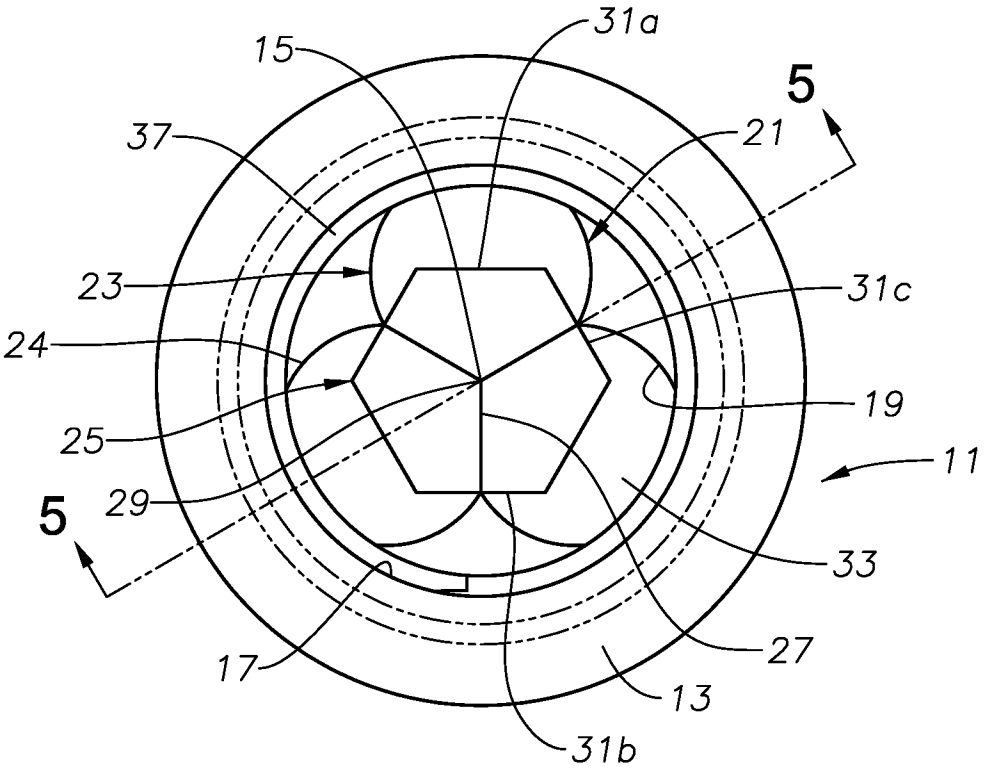
FIG. 4 is a top view of the tool of FIG. 1.

FIG. 4 shows that while jaws 21 are in the contracted position, inner corners 29 will be substantially on body axis 15. Retainer ring 37 overlies an outer portion of each shelf 33.

Figure 5:
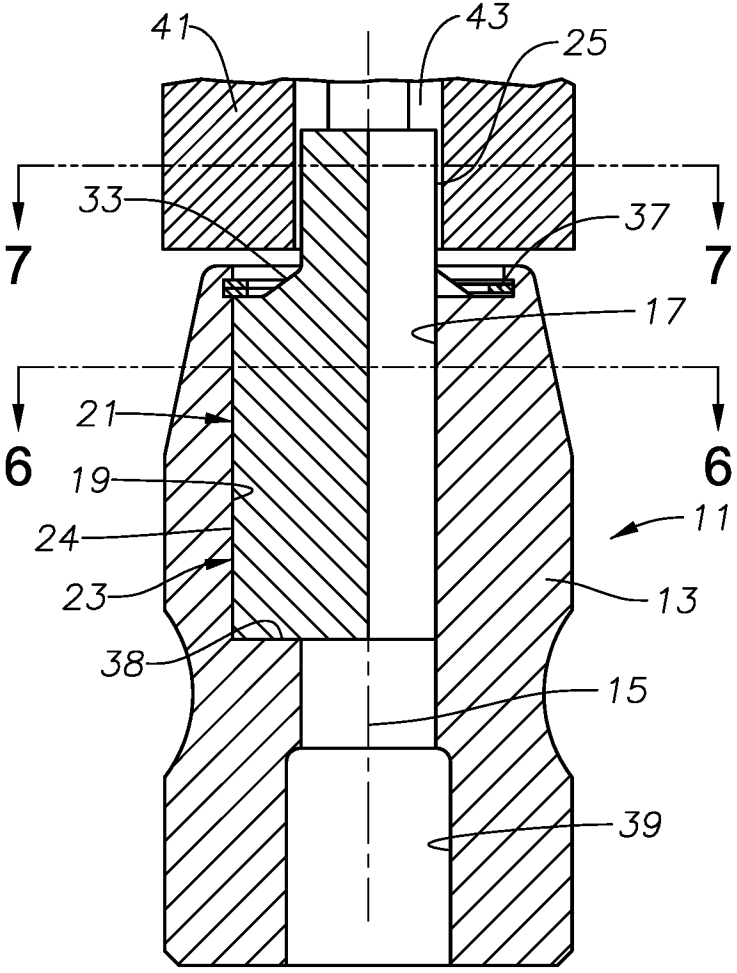
FIG. 5 is an axial sectional view of tool of FIG. 1, shown inserted into a socket in a workpiece.

Referring to FIG. 5, an end of each jaw 21 engages a shoulder 38 formed in cavity 17. Cavity 17 has a polygonal recess or socket 39 at the end opposite engaging portion 25 to receive a drive tool (not shown). The drive tool, which may be an air impact tool, imparts rotation to body 13.

FIG. 5 also illustrates torque tool 11 engaging a workpiece 41, which may be an Allen screw having a threaded section (not shown) and a head with a hexagonal socket having six drive flats 43. Torque tool drive flats 31 mate with drive flats 43 in workpiece 41 to impart torque for loosening and/or tightening.

Figure 6:
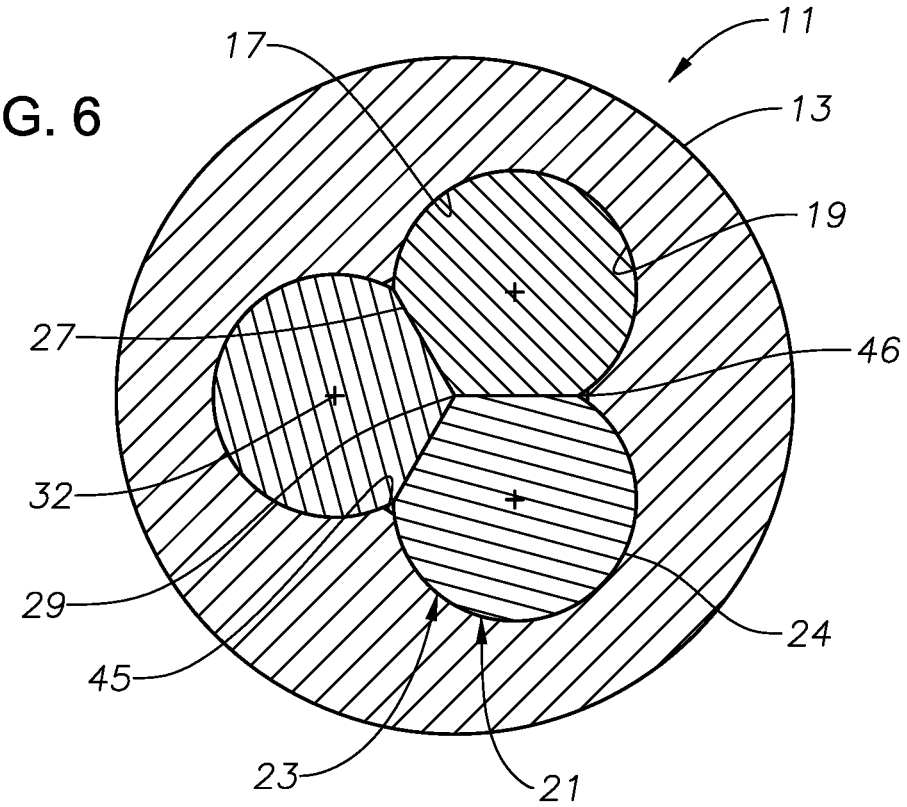
FIG. 6 is a sectional view of the tool of FIG. 1 taken along the line 6-6 of FIG. 5 and showing the jaws contracted.

FIG. 6 illustrates cam portions 23 of jaws 21 in a retracted position. The three inner corners 29 are located substantially on axis 15. Each inner flank 27 will be in abutment with the inner flank 27 of another of the jaws 21 and located on a radial line of axis 15. Cavity 13 has a three axially extending corner ridges 45, each at the edge of adjacent receptacles 19 and located 120 degrees apart from each other. Corner ridges 45 of each receptacle 19 define the inward facing opening of each receptacle 19. Flat flanks 27 protrude inward from each opening defined by corner ridges 45. Each corner ridge 45 is on a radial line with one of the mating sets of inner flanks 27 while tool 11 is in the contracted position. Each jaw 21 has two transition points or outer corners 46, each outer corner 46 being a junction with curved outer surface 24 and one of the inner flanks 27. While in the contracted position, each outer corner 46 is on a radial line with one of the corner ridges 45 and symmetrical with the outer corner 46 of an adjacent one of the jaws 21.

Figure 7:
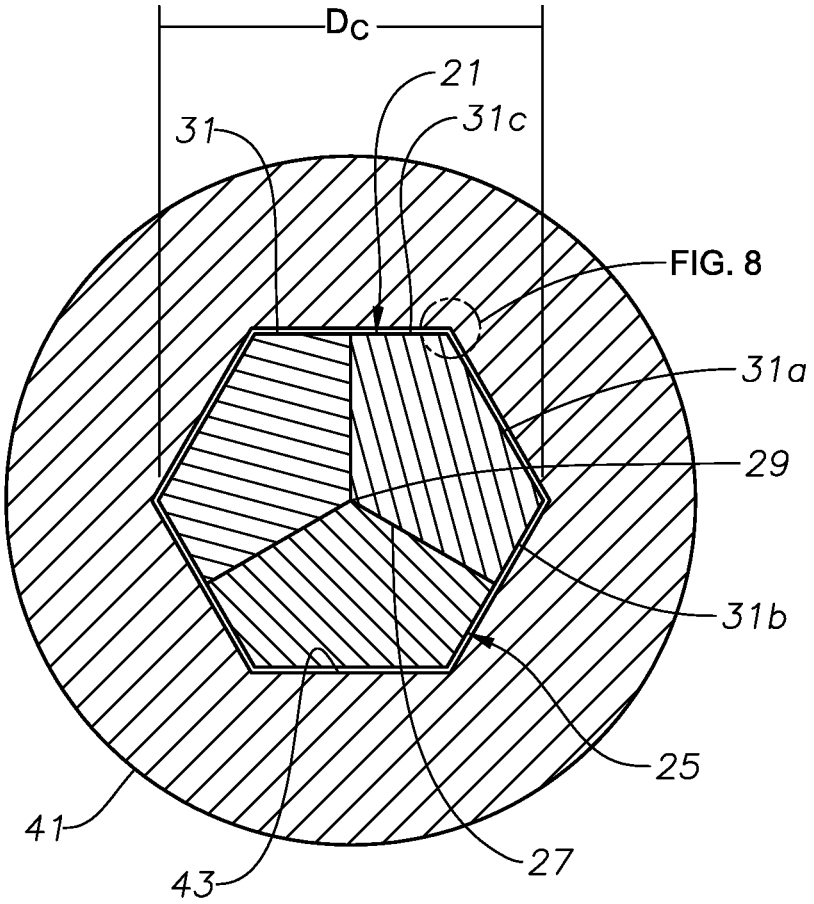
FIG. 7 is a sectional view of the tool of FIG. 1 taken along the line 7-7 of FIG. 5 and showing the jaws contracted.

FIG. 7 shows engaging portions 25 inserted into the socket of workpiece 41 while in a contracted position. The circumscribed diameter Dc of the assembled engaging portions 25 while contracted will be slightly less than the circumscribed diameter of workpiece drive flats 43. The circumscribed diameter Dc is measured between opposite outer corners of the assembled engaging portions 25. FIG. 8 illustrates that if the assembled engaging portions 25 are precisely coaxially inserted into the workpiece socket, due to tolerances, a uniform gap Gc will exist between each engaging portion drive flat 31*a, b* and *c* and each workpiece drive flat 43 while contracted.

Referring to FIG. 9, body 13 has been rotated a slight increment relative to jaws 21, as indicated by the arrow. This relative rotation may occur due to contact with engaging portion drive flats 31 with drive flats 43 of workpiece 41 (FIG. 7) while torque is initially being applied to body 13. Relative rotation may also occur due to inertia when an impact wrench begins to rapidly rotate body 13. Regardless of the direction, the rotation causes jaw inner corners 29 to move away from axis 15 and from each other a short distance. Inner flanks 27 of each jaw 21 slide or linearly move slightly relative to each other. Outer corners 46 become misaligned with each other and with corner ridges 45. A radial line from axis 15 passing through a center of each corner ridge 45 does not pass through a center of each outer corner 46. If the rotation of body 13 is in the direction of the arrow, illustrated as counterclockwise, each counter ridge 45 moves a few degrees counterclockwise relative to the center of one of the outer corners 46.

If the rotation of body 13 is in the opposite direction, clockwise, each corner ridge 45 moves clockwise a few degrees relative to one of the outer corners 46. The counterclockwise relative rotation shown in FIG. 9 causes inner corners 29 to move radially apart from each other and from axis 15.

Figure 10:
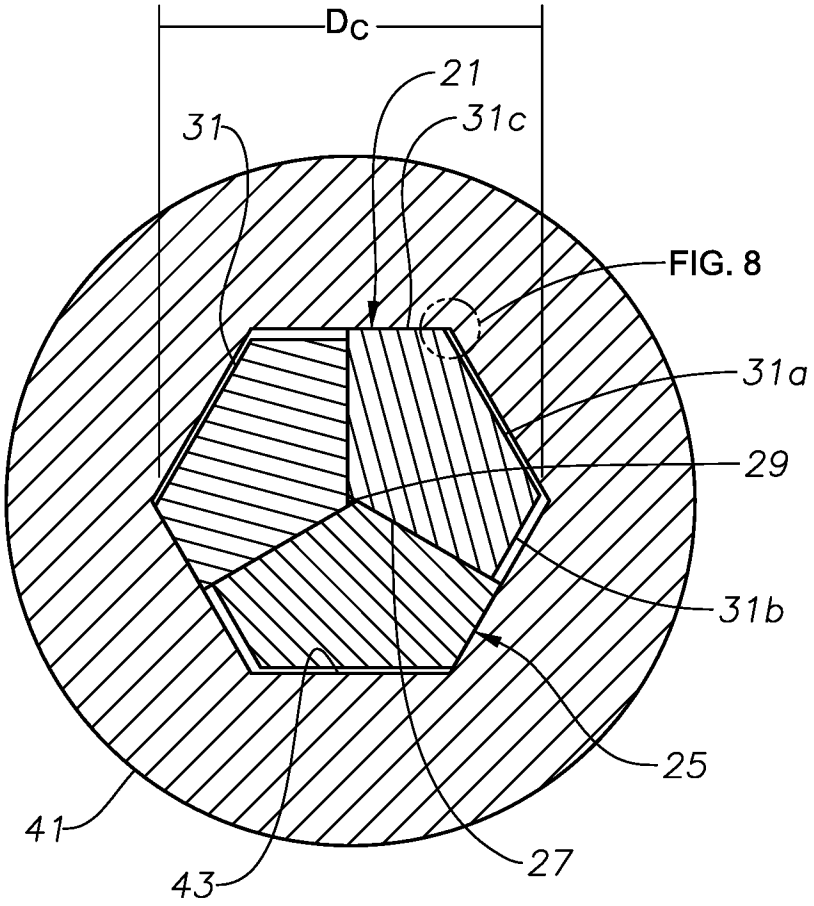
FIG. 10 is a sectional view similar to FIG. 7, but showing the jaws contracted.
Figure 11:
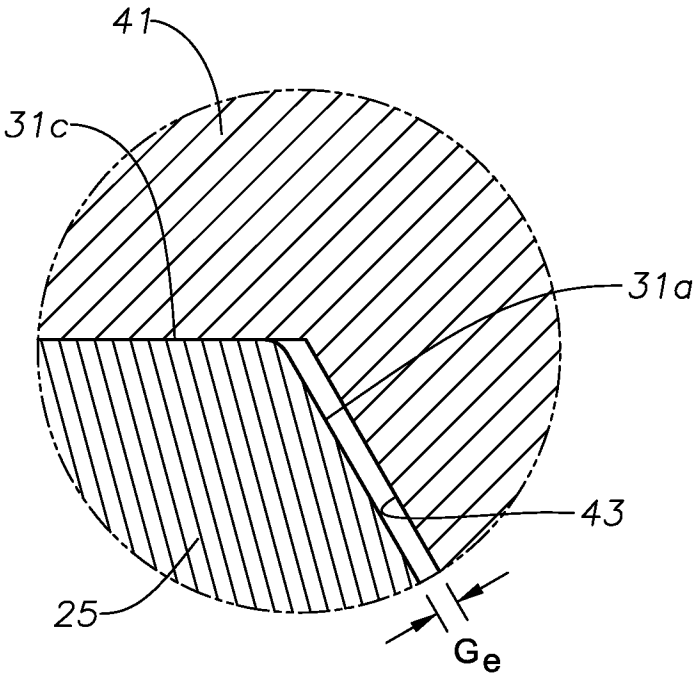
FIG. 11 is an enlarged sectional view of the portion encircled in FIG. 10.

Referring to FIGS. 10 and 11, the relative rotation that occurred in FIG. 9 causes each of the lateral drive flat 31*c* of each engaging portion 25 to move outward into flat abutment with one of the drive flats 43 of workpiece 41. The gap Gc (FIG. 8) between each lateral drive flat 31*c* and a mating drive flat 43 that existed while tool 11 is contracted closes. The gap Gc (FIG. 8) between each of the other lateral drive flats 31*a* and a mating drive flat 43 increases to an expanded position gap Ge. Continuing to apply torque to body 13 (FIG. 9) transfers torque from lateral drive flats 31*c* of engaging portions 25 to mating workpiece drive flats 43. The surface area of the flush line-to-line contact between each lateral drive flat 31*c* and the mating workpiece drive flat 43 extends approximately one half the width of each workpiece drive flat 43.

Similarly, if the rotation of body 13 is in the opposite direction, the opposite lateral drive flats 31*b* will abut mating workpiece drive flats 43. Expanded gap Ge will now exist between lateral drive flats 31*c* and mating workpiece drive flats 43. Expanded gap Ge always exists between middle drive flat 31*a* and the adjacent workpiece drive flats 43. Middle drive flats 31*a* thus do not transfer torque, regardless of the direction of rotation, and need not be a planar surface.

Figure 13:
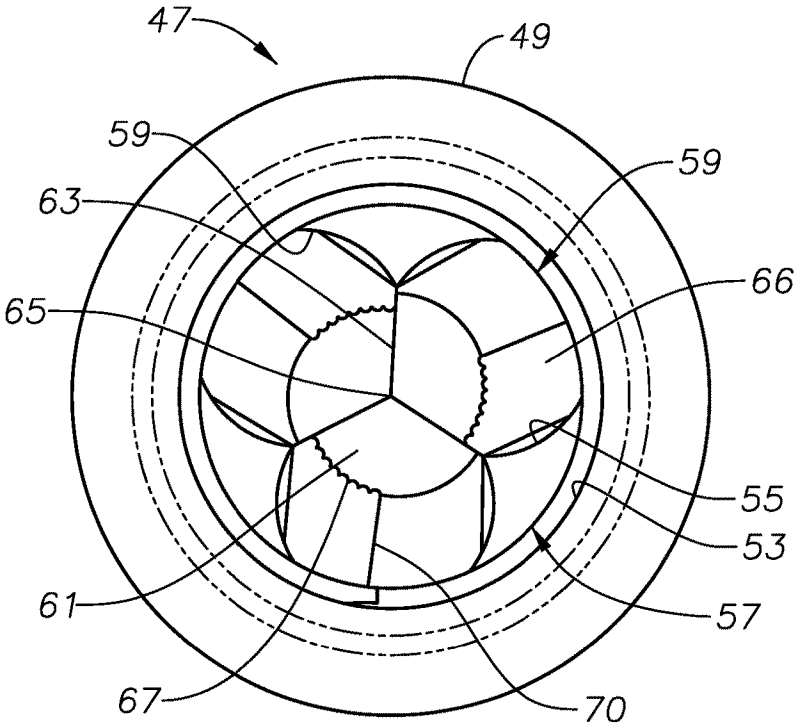
FIG. 13 is a top view of the tool of FIG. 12.
Figure 12:
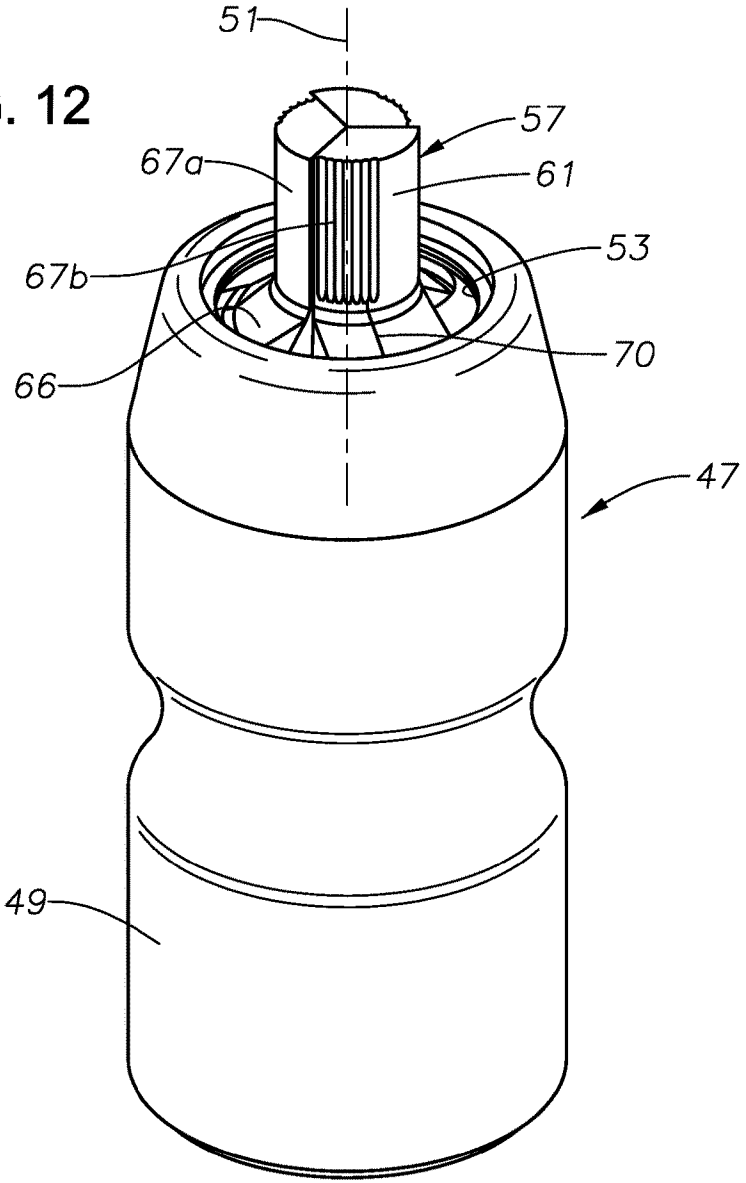
FIG. 12 is a perspective view of a second embodiment of a tool constructed in accordance with this disclosure.

Referring to FIGS. 12 and 13, torque tool 47 operates with many of the same principles as torque tool 11 of the first embodiment, but it is used for a different purpose than loosening and tightening screws with heads having drive sockets. Torque tool 47 has a body 49 that is the same as body 13 (FIG. 1) of the first embodiment. Body 49 has an axis 51 and an axial cavity 53 extending through body 49. Cavity 53 has a plurality of partly cylindrical receptacles 55 (three shown) with openings facing inward toward axis 51.

Jaws 57 have cam portions 59 that fit within receptacles 55. Each jaw 57 has an engaging portion 61 protruding from cavity 53. Engaging portions 61 are schematically illustrated and would likely protrude from body 49 much more so than shown. Each jaw 57 has two flat flanks 63 on its inner side that intersect each other at an obtuse inner corner 65. Inner corners 65 are located on axis 51 while jaws 57 are in the contracted position, shown in FIGS. 12-14. Each engaging portion 61 has a rounded outer surface 67. A shelf 66 extends outward from the base of each engaging portion 61 at the end of cam portion 59 and faces in an axial direction away from cavity 53. In this embodiment, while contracted, the circumscribed outer diameter of the assembled jaws 57 measured at engaging portions 61 is less than the circumscribed outer diameter measured at cam portion 59.

Outer surface 67 has a curved, smooth portion 67*a* that is partly cylindrical and extends about half the circumferential dimension of outer surface 67, but that can vary. Outer surface 67 also has a teeth portion 67*b* that extends about half the circumferential dimension of outer surface 67, but that can vary. Teeth portion 67*b* contains a plurality of teeth, which are straight, elongated grooves with sharp crests. The teeth of teeth portion 67*b* extend axially the length of engaging portion 61 and are parallel with each other. Teeth portion 67*b* is located on a part of outer surface 67 that is also partly cylindrical, but has a different center point for its radius than smooth portion 67*a* in this embodiment. The center point for the radius of smooth portion 67*a* is illustrated to be on inner corner 65, but it could be elsewhere.

An outer corner 68*a* is formed at the intersection of smooth portion 67*a* with one of the flanks 63. An outer corner 68*b* is formed at the intersection of teeth portion 67*b* with the other of the flanks 63. Each outer corner 68*a*, 68*b* is at an acute angle slightly less 90 degrees with one of the flanks 63 in this example. A transition line 70 is located at the border of teeth portion 67*b* with smooth portion 67*a*. Transition line 70 extends along shelf 66 as well.

Figure 14:
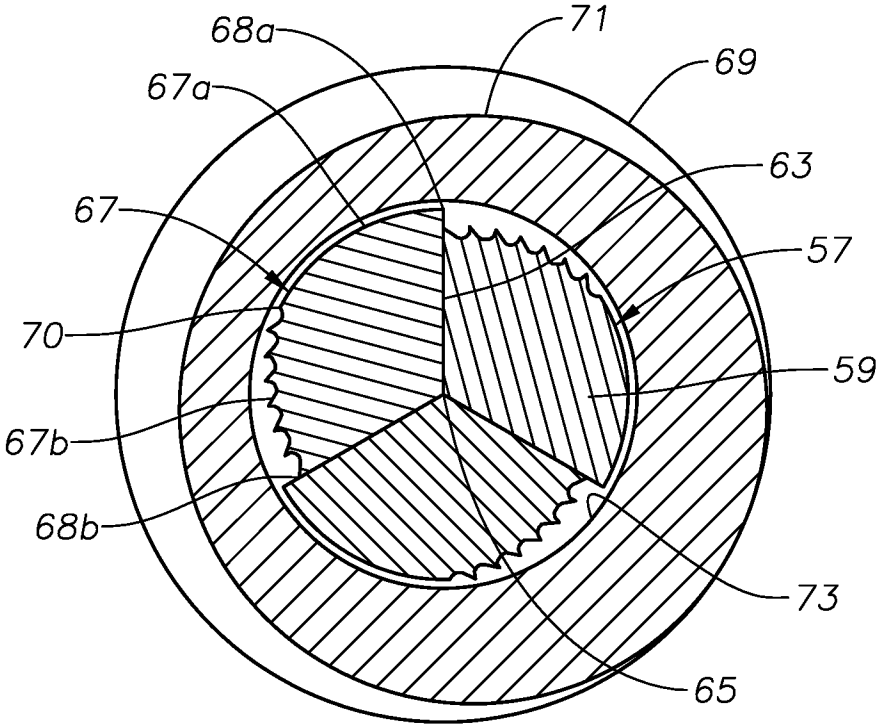
FIG. 14 is a transverse sectional view of the tool of FIG. 12, shown inserted into a hole in a workpiece and in a contracted position.

Referring to FIG. 14, a purpose of torque tool 47 is to remove a threaded rod, bolt or screw 69 from a mating threaded hole. Threaded rod 69 has a thread 71 extending helically around it. An operator drills a hole or bore 73 into threaded rod 69 along its axis. The operator then inserts assembled engaging portions 61 into hole 73 with engaging portions 61 in the contracted position of FIG. 14.

The diameter of hole 73 and the location of the center point for the radius of smooth portion 67*a* are preferably selected so that when in the contracted position and coaxially inserted into hole 73, smooth portion 67*a* will be substantially parallel or concentric with part of the side wall of hole 73, and spaced radially inward by a small uniform gap. The diameter of hole 73 and the location of the center point for the radius of teeth portion 67*b* are preferably selected so that while in the contracted position and coaxially inserted into hole 73, the curvature of teeth portion 67*b* will not be parallel with the side wall of hole 73. A gap between teeth portion 67*b* and the side wall of hole 73 increases from the transition line 70 to the outer corner 68*b*. While in the contracted position of FIG. 14, inner corners 65 are in abutment with each other on axis 51.

The operator then uses a rotating device, such as an impact wrench, to rotate body 49. A few degrees of rotation of body 49 relative to engaging portions 61 occurs initially, as indicated by the arrow in FIG. 15. The relative rotation may be due to inertia or contact between the side wall of hole 73 and the outer surface 67 of one of the engaging portions 61. The relative rotation causes inner corners 65 to move radially apart from each other and from axis 51. Flanks 63 slide relative to each other. Teeth portion 67*b* of each outer surface 67 will contact and grip the side wall of hole 73. Preferably, each tooth of teeth portion 67*b* is inclined into the direction of rotation to assist in embedding and gripping the side wall of hole 73.

Figure 15:
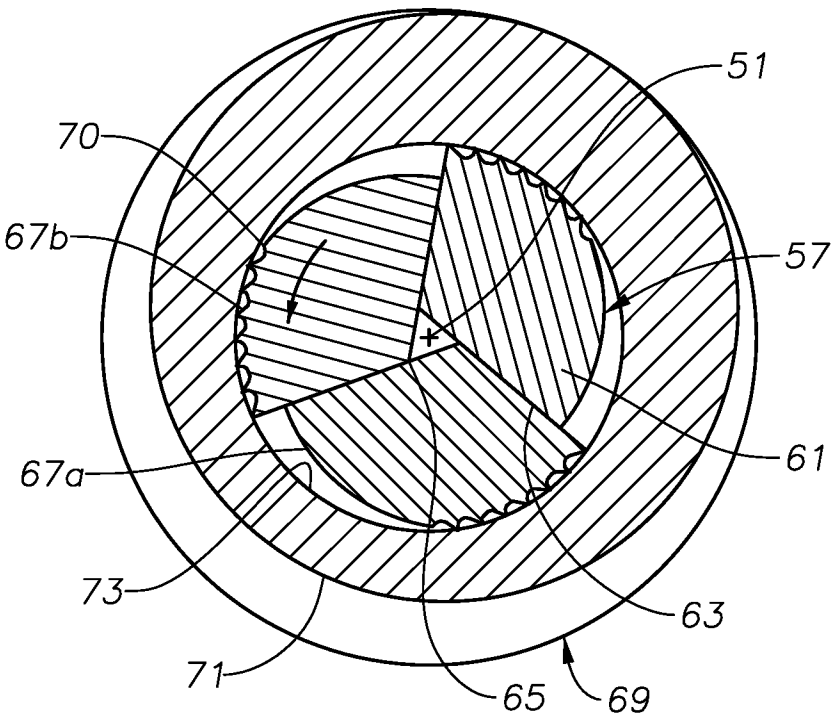
FIG. 15 is a sectional view of the tool of FIG. 12 similar to FIG. 14, but showing the tool in an expanded position.

In the expanded position of FIG. 15, the curvature of teeth portion 67*b* will preferably be the same as the side wall of hole 73 so as to make flush contact. In the expanded position, smooth portion 67*a* will be misaligned with the side wall of hole 73. A gap between smooth portion 67*a* and the side wall of hole 73 decreases from each outer corner 68*a* to transition line 70.

The circumscribed diameter of engaging portions 61 while in the expanded position is slightly greater than the circumscribed diameter of engaging portions 61 while in the contracted position. The circumscribed diameter in the expanded position may be measured from one of the outer corners 68*b* to the transition line 70 on an opposite engaging portion 61. The circumscribed diameter in the contracted position may be measured from one of the outer corners 68*a* to the transition line 70 on an opposite engaging portion 61.

Continued rotation of body 49 causes engaging portions 61 to rotate in unison, unscrewing threaded rod 69. When torque tool 47 is used in this manner, it may be referred to as a Dutchman's tool.

The present invention described herein, therefore, is well adapted to carry out the objects and attain the ends and advantages mentioned, as well as others inherent therein. While two presently preferred embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. An apparatus for engaging and rotating a workpiece, comprising:

a body having a cavity with a central longitudinal cavity axis disposed at a center of the cavity;

the cavity having a plurality of receptacles, each of the receptacles having a partly cylindrical receptacle surface and an opening facing inward toward the cavity axis, each of the receptacles having a central longitudinal receptacle axis that is parallel to and offset from the cavity axis and disposed at a center of each partly cylindrical receptacle surface;

a plurality of jaws, each of the jaws having a cam portion within a corresponding one of the receptacles and a workpiece engaging portion protruding from the cavity and located exterior of the body;

each of the cam portions having a partly cylindrical cam portion outer surface that is received in engagement with the respective partly cylindrical receptacle surface within one of the receptacles, each of the cam portions having a pair of flat flanks that protrude inward from the opening of one of the receptacles toward the cavity axis, each flank of the respective pairs of flanks intersecting each other at an inner corner that is radially inward from the cam portion outer surface relative to the cavity axis, each of the flanks of each of the cam portions abutting a corresponding one of the flanks of another of the cam portions;

each of the engaging portions having an outer surface configured to engage a hole within the workpiece; and wherein rotation of the body relative to the jaws causes the partly cylindrical receptacle surfaces to rotate relative to the corresponding cam portion outer surfaces, the inner corners of the flank pairs to move outward from the cavity axis, and the outer surfaces of the engaging portions to move from a contracted position to an expanded position.

2. The apparatus according to claim 1, wherein the partly cylindrical receptacle surface of each of the receptacles from one edge of the opening to another edge of the opening extends greater than 180 degrees.

3. The apparatus according to claim 1, further comprising:

a plurality of corner ridges in the cavity protruding toward the cavity axis; and wherein each of the corner ridges in the cavity divides one of the receptacles from an adjacent one of the receptacles, each of the corner ridges being parallel with and located closer to the cavity axis than the receptacle axis of each of the receptacles.

4. The apparatus according to claim 1, wherein:

the plurality of receptacles comprises three of the receptacles;

each partly cylindrical receptacle surface of each of the receptacles extends greater than 180 degrees and has side edges joining adjacent ones of the receptacles, each of the side edges defining a corner ridge that is parallel to the cavity axis and spaced closer to the cavity axis than the receptacle axis of each of the receptacles;

each of the cam portions has an outer corner dividing one edge of the cam portion outer surface from one of the flanks;

while in the contracted position, each of the corner ridges is radially aligned with one of the outer corners relative to the cavity axis; and while in the expanded position, each of the corner ridges is radially misaligned with one of the outer corners relative to the cavity axis.

5. The apparatus according to claim 1, wherein:

the flanks of the each of the cam portions extend axially from the cavity to a tip of each of the engaging portions.

6. The apparatus according to claim 1, wherein each of the engaging portions comprises a single integral piece with one of the cam portions.

7. The apparatus according to claim 1, wherein:

the outer surfaces of the engaging portions define a polygonal configuration.

8. The apparatus according to claim 1, wherein:

the outer surface of each of the engaging portions is a curved surface; and teeth are located on the outer surface for gripping the hole in the workpiece while in the expanded position.

9. The apparatus according to claim 1, wherein:

the outer surface of each of the engaging portions is a curved surface having a first portion and a second portion;

the first portion comprises a smooth cylindrical surface having a radius emanating from the corresponding inner corner; and the second portion comprises a plurality of teeth located along a curved surface having a different radius than the radius of the first portion for gripping the hole in the workpiece while in the expanded position.

10. The apparatus according to claim 9, wherein:

the first portion is configured to be concentric with part of the hole in the workpiece and the second portion is configured to be misaligned with part of the hole in the workpiece while the jaws are in the contracted position; and the second portion is configured to be concentric with part of the hole in the workpiece, and the first portion is configured to be misaligned with part of the hole in the workpiece while the jaws are in the expanded position.

11. An apparatus for engaging and rotating a workpiece, comprising:

a body having a longitudinal axis and an axially extending cavity;

the cavity having a plurality of partly cylindrical receptacles, each of the receptacles having an opening facing inward toward the axis;

a plurality of jaws, each of the jaws having a cam portion within a corresponding one of the receptacles and a workpiece engaging portion protruding from the body;

each of the cam portions having a partly cylindrical outer surface that is received within a corresponding one of the receptacles, each of the cam portions having a pair of flat flanks that protrude inward from the opening of one of the receptacles, each flank of the respective pairs of flanks intersecting each other at an inner corner, each of the flanks of each of the cam members abutting one of the flanks of another of the cam members;

each of the engaging portions having an outer surface configured to engage a hole within the workpiece; wherein rotation of the body relative to the jaws causes the inner corners of the flanks to move outward from the axis and the outer surfaces of the engaging portions to move from a contracted position to an expanded position;

the plurality of jaws comprises three of the jaws;

the outer surface of each of the engaging members has a center drive flat and lateral drive flats on opposite edges of the center drive flat, the center drive flat having a width twice that of each of the lateral drive flats; and the center and lateral drive flats of each of the engaging members are configured such that while in the expanded position one of the lateral drive flats will be in abutment with a flat drive surface in the hole of the workpiece to impart torque and the other of the lateral drive flats will be spaced by a gap from another of the flat drives surfaces in the hole of the workpiece.

12. An apparatus for engaging and rotating a workpiece, comprising:

a body having a cavity with a central longitudinal cavity axis;

the cavity having three receptacles spaced around and joining each other at corner ridges, the receptacles opening inward toward the cavity axis, each of the receptacles having a partly cylindrical receptacle surface extending from one of the corner ridges to another of the corner ridges, each of the partly cylindrical receptacle surfaces having a central longitudinal receptacle axis parallel to and radially spaced outward from the cavity axis;

three jaws, each of the jaws having a cam portion fitting within a corresponding one of the receptacles and being rotatably slidable in said one of the receptacles, and a workpiece engaging portion protruding from the body and located exterior of the cavity, each of the cam portions having a center point that coincides with one of the receptacle axes;

each of the cam portions having a cylindrical cam portion outer surface that is received within one of the receptacles in contact with one of the partly cylindrical receptacle surfaces, each of the cam portions having a pair of flat flanks extending from the cam portion outer surface toward the cavity axis, each flank of the respective pairs of flanks intersecting each other at an inner corner that is radially inward from the cam portion outer surface relative to the cavity axis, each of the flanks of each of the cam portions abutting and being slidable relative to one of the flanks of another of the cam portions;

each of the engaging portions having an outer surface configured to engage a hole within the workpiece; wherein while in a contracted position, the inner corners are located on the cavity axis;

rotation of the body relative to the jaws causes the inner corners of the flanks to move away from each other and outward from the cavity axis to an expanded position; and while in the expanded position, the outer surfaces of the engaging portions define a circumscribed diameter that is greater than while in the contracted position in order to grip the hole in the workpiece to transmit torque from the body to the workpiece.

13. The apparatus according to claim 12, wherein:

each of the cam portions has outer corners at intersections of the flanks with the cam portion outer surface;

while in the contracted position, each of the corner ridges is radially aligned relative to the cavity axis with one of the outer corners; and while in the expanded position, each of the corner ridges is radially misaligned relative to the cavity axis with one of the outer corners.

14. The apparatus according to claim 12, wherein:

the outer surface of each of the engaging portions is a curved surface having a first portion and a second portion;

the first portion comprises a smooth cylindrical surface having a selected curvature;

the second portion comprises a plurality of teeth located along a curved surface having a different curvature than the first portion;

the curvature of the second portion is selected to create a gap between the second portion and any part of the hole in the workpiece while the jaws are in the contracted position, and the curvature of the second portion is configured to close the gap while the jaws are in the expanded position.

15. The apparatus according to claim 14, wherein the first portion of each of the engaging portions has a radius emanating from the inner corner.

16. An apparatus for engaging and rotating a workpiece, comprising:

a body having a longitudinal axis and an axially extending cavity;

the cavity having three receptacles spaced around and joining each other at corner ridges, the receptacles opening inward toward the axis, each of the receptacles having a receptacle cylindrical surface extending from one of the corner ridges to another of the corner ridges, each of the receptacle cylindrical surfaces having a center point radially spaced outward from the axis;

three jaws, each of the jaws having a cam portion fitting within a corresponding one of the receptacles and being rotatably slidable in said one of the receptacles, and a workpiece engaging portion protruding from the body, each of the cam portions having a center point that coincides with one of the receptacle center points;

each of the cam portions having a cylindrical outer surface that is received within a corresponding one of the receptacles, each of the cam portions having a pair of flat flanks extending from the cylindrical outer surface toward the axis, each flank of the respective pairs of flanks intersecting each other at an inner corner, each of the flanks of each of the cam members abutting and being slidable relative to one of the flanks of another of the cam members;

each of the engaging portions having an outer surface configured to engage a hole within the workpiece; wherein while in a contracted position, the inner corners are located on the axis; and rotation of the body relative to the jaws causes the inner corners of the flanks to move away from each other and outward from the axis to an expanded position;

while in the expanded position, the outer surfaces of the engaging portions define a circumscribed diameter that is greater than while in the contracted position in order to grip the hole in the workpiece to transmit torque from the body to the workpiece;

the outer surface of each of the engaging members has a center drive flat and lateral drive flats on opposite edges of the center drive flat, the center drive flat having a width twice that of each of the lateral drive flats; and while in the expanded position, one of the lateral drive flats of each of the engaging members will be farther from the axis than the other of the lateral drive flats in order to abut a flat drive surface in the hole of the work piece to impart torque.

17. An apparatus for engaging and rotating a workpiece, comprising:

a body having a longitudinal axis and an axially extending cavity;

the cavity having three receptacles spaced around and joining each other at corner ridges, the receptacles opening inward toward the axis, each of the receptacles having a receptacle cylindrical surface extending from one of the corner ridges to another of the corner ridges, each of the receptacle cylindrical surfaces having a center point radially spaced outward from the axis;

three jaws, each of the jaws having a cam portion fitting within a corresponding one of the receptacles and being rotatably slidable in said one of the receptacles, and a workpiece engaging portion protruding from the body, each of the cam portions having a center point that coincides with one of the receptacle center points;

each of the cam portions having a cylindrical outer surface that is received within a corresponding one of the receptacles, each of the cam portions having a pair of flat flanks extending from the cylindrical outer surface toward the axis, each flank of the respective pairs of flanks intersecting each other at an inner corner, each of the flanks of each of the cam members abutting and being slidable relative to one of the flanks of another of the cam members;

each of the engaging portions having an outer surface configured to engage a hole within the workpiece; wherein while in a contracted position, the inner corners are located on the axis; and rotation of the body relative to the jaws causes the inner corners of the flanks to move away from each other and outward from the axis to an expanded position;

while in the expanded position, the outer surfaces of the engaging portions define a circumscribed diameter that is greater than while in the contracted position in order to grip the hole in the workpiece to transmit torque from the body to the workpiece; wherein:

the outer surface of each of the engaging portions is a curved surface; and a plurality of teeth are located on the outer surface for gripping the hole in the workpiece while in the expanded position.

18. A method for engaging and rotating a workpiece with a tool, the tool comprising:

a body having an axially extending cavity with a central longitudinal cavity axis;

the cavity having a plurality of partly cylindrical receptacles spaced around and opening inward toward the cavity axis, each of the receptacles having a central longitudinal receptacle axis that is radially outward from and parallel to the cavity axis;

a plurality of jaws, each of the jaws having a cam portion within a corresponding one of the receptacles and a workpiece engaging portion protruding from the body exterior of the cavity;

each of the cam portions having a partly cylindrical cam portion outer surface that is received within one of the receptacles, each of the cam portions having a pair of flat flanks that intersect each other at an inner corner, each of the flanks of each of the cam members abutting one of the flanks of another of the cam members, the inner corner being radially inward from the cam portion outer surface relative to the cavity axis;

aligning the inner corners with the cavity axis to define a contracted position and inserting the engaging portions into a hole within the workpiece;

rotating the body relative to the jaws, causing the inner corners of the flank pairs to move outward from the cavity axis and the outer surfaces of the engaging portions to move from the contracted position to an expanded position in gripping engagement with the workpiece; and continuing to rotate the body to transmit torque from the body to the workpiece.

19. The method according to claim 18, wherein:

a corner ridge in the cavity divides each of the receptacles from adjacent ones of the receptacles, each of the corner ridges being parallel and located closer to the cavity axis than the receptacle axis of each of the receptacles;

each of the cam portions has an outer corner at an intersection of one edge of each of the flanks with the cam portion outer surface; the method further comprising:

while in the contracted position, radially aligning relative to the cavity axis each of the corner ridges with one of the outer corners; and while in the expanded position, radially misaligning relative to the cavity axis each of the corner ridges with one of the outer corners.

20. The method according to claim 18, wherein:

the hole of the workpiece has polygonal drive flats;

the outer surfaces of the engaging members define a polygonal configuration; and rotating the body relative to the jaws causes the outer surfaces of the engaging portions to abut the polygonal drive flats.

21. The method according to claim 18, wherein:

the hole of the workpiece is a cylindrical bore;

the outer surface of each of the engaging members has teeth; and rotating the body relative to the jaws causes the teeth on the outer surfaces of the engaging portions to embed into the cylindrical bore.

* * * * *